US008002161B2

(12) United States Patent
Maemori

(10) Patent No.: US 8,002,161 B2
(45) Date of Patent: Aug. 23, 2011

(54) STAPLER HAVING SPECIFIC CLINCHER GROOVE FOR STABILIZING STAPLE PATH

(75) Inventor: Jun Maemori, Chuo-ku (JP)

(73) Assignee: Max Co., Ltd., Tokyo (JP)

( * ) Notice: Subject to any disclaimer, the term of this patent is extended or adjusted under 35 U.S.C. 154(b) by 94 days.

(21) Appl. No.: 12/440,673

(22) PCT Filed: Sep. 21, 2007

(86) PCT No.: PCT/JP2007/068450

§ 371 (c)(1),
(2), (4) Date: Mar. 10, 2009

(87) PCT Pub. No.: WO2008/041529

PCT Pub. Date: Apr. 10, 2008

(65) Prior Publication Data

US 2010/0059569 A1 Mar. 11, 2010

(30) Foreign Application Priority Data

Sep. 27, 2006 (JP) ..... 2006-263377

(51) Int. Cl.
*B25C 5/02* (2006.01)
*B25C 5/11* (2006.01)

(52) U.S. Cl. ..... 227/155; 227/120; 227/119

(58) Field of Classification Search ..... 227/155, 227/120, 134, 119, 19
See application file for complete search history.

(56) References Cited

U.S. PATENT DOCUMENTS 2,267,185 A * 12/1941 Bauwens ..... 227/77
3,915,366 A * 10/1975 Mitchell ..... 227/83
4,002,281 A * 1/1977 Hsu ..... 227/63
4,119,258 A * 10/1978 Ewig, Jr. ..... 227/132
4,194,666 A * 3/1980 Spehrley et al. ..... 227/155
4,206,863 A * 6/1980 Savino ..... 227/83
4,315,589 A * 2/1982 Soong ..... 227/155
4,520,956 A * 6/1985 Urresti ..... 227/120
4,623,082 A * 11/1986 Kurosawa ..... 227/7
5,364,000 A * 11/1994 Fealey ..... 227/124
5,497,931 A * 3/1996 Nakamura ..... 227/109
5,497,933 A * 3/1996 DeFonzo et al. ..... 227/175.1
6,056,183 A * 5/2000 Tanabe ..... 227/155
6,059,504 A * 5/2000 Ishida et al. ..... 412/39
7,021,512 B1 * 4/2006 Nakamura ..... 227/76
7,644,851 B2 * 1/2010 Sugihara et al. ..... 227/155

(Continued)

FOREIGN PATENT DOCUMENTS

JP 2-82 1/1990

(Continued)

*Primary Examiner* — Brian D Nash
(74) *Attorney, Agent, or Firm* — Drinker Biddle & Reath LLP

(57) ABSTRACT

A stapler includes a base, a magazine part rotatably supported by a rear end portion of the base, a handle part configured to strike the staple, and a clincher part provided on a front portion of the base to fold legs of the staple which has been struck. A width of a clincher groove in a front and rear direction is larger than a width of a side face of the staple. A bottom face of the clincher groove includes a flat face section provided on a rear side in the front and rear direction and an slope face section provided on a front side. The flat face section is substantially perpendicular to a direction in which staple is struck, and the slope face section is inclined such that a front side of the slope face section is higher than the rear side of the slope face section.

7 Claims, 6 Drawing Sheets

FOREIGN PATENT DOCUMENTS

| | | |
|---|---|---|
| JP | 11-28682 | 2/1999 |
| JP | 2004-276196 | 10/2004 |
| JP | 2005-022079 | 1/2005 |
| WO | WO 03/057417 A1 | 7/2003 |
| WO | WO 03/090975 A1 | 11/2003 |

* cited by examiner

STAPLER HAVING SPECIFIC CLINCHER GROOVE FOR STABILIZING STAPLE PATH

TECHNICAL FIELD

The present invention relates to a stapler having a driver which strikes out a staple loaded in a magazine toward sheets of paper, and a clincher groove which folds legs of the staple, that has penetrated through the sheets of paper, along a back face of the sheets of paper.

BACKGROUND ART

Generally, a stapler includes a base which has a binding table at a front end portion thereof, and sheets of paper are placed on the binding table. The stapler further includes a handle, a driver provided at a distal end of the handle, and a magazine which is positioned above the sheets of paper. When the handle is pressed down, a staple inside the magazine is downwardly driven out by the driver. Legs of the staple which has penetrated through the sheets of paper are folded along a back face of the sheets of paper by a clincher groove in a clincher part which is provided below the sheets of paper. As the result, the sheets of paper are bound.

The number of the sheets of paper to be bound is not always the same, and may be two or three, and sometimes may be forty or fifty. A thickness of the sheets of paper through which the staple has to penetrate is different depending on the number of the sheets. In a case in which the number of the sheets is small, the sheets of paper have a small thickness, and hence, the staple is not stably held by the sheets of paper in a state in which the staple has penetrated through the sheets of paper. Further, the sheets of paper may sometimes move while the handle is being pressed with force, and in such a case, the legs of the staple may sway.

Moreover, depending on the thickness of the sheets of paper to be bound, a striking angle of the legs of the staple at the time when they penetrate the sheets of paper subtly varies, and positions at which the legs of the staple come into contact with the clincher groove after penetrating the sheets of paper also subtly vary.

For such reasons, there is known a stapler which can bind a number of sheets of paper such as forty or fifty, in which sufficient length and width of a clincher groove are ensured and in which respective end portions of the clincher groove in a widthwise direction are curved such that an inner face of the clincher groove has an arcuate sectional shape (see, e.g., JP 11-28682 A).

Further, there is also known a stapler which is configured such that a clincher groove is movable in up and down directions instead of being fixed to the base. In this type of stapler, when a staple is driven out by downwardly moving a driver, a clincher groove is also moved downward until the legs of the staple penetrate the sheets of paper. Thereafter, by further moving the driver downward, the legs of the staple are inwardly folded by the clincher groove. Also in this stapler, a width of the clincher groove in a longitudinal direction of the stapler is set to be larger than a width of a side face of the staple, as shown in FIG. 6A. A bottom face of the clincher groove has a flat face section which is substantially perpendicular to a striking direction of the staple.

However, although a driver 40 is provided at a distal end of the handle perpendicularly with respect to the handle, the handle is rotatable. Therefore, when striking the staple, a lower end face 41 of the driver 40 is not parallel to the bottom face 43 of the clincher groove 42, but is slightly inclined rearward. In addition, when a user performs a clinching action to fold the legs 10 of the staple on the clincher groove 42 after the legs of the staple have penetrated through the sheets of paper, the entire stapler is likely to be pulled toward the user (i.e., toward a rear side of the stapler). When the stapler moves toward the user, the sheets of paper relatively moves to a front side of the stapler.

Therefore, in a case in which the sheets of paper to be bound has a small thickness, lower ends of the legs 10 of the staple are likely to slide to the front side of the stapler as shown in FIG. 6B, and the legs 10 of the staple are likely to become rearwardly inclined. In a case in which the sheets of paper to be bound has a large thickness, an angle of the sheets of paper becomes unmatched with the bottom face 43 of the clincher groove, and hence, the bent legs 10 becomes likely to move to the front side of the clincher groove. Therefore, also in this case, the legs 10 of the staple are likely to be inclined rearward.

In order to address the disadvantages described above, as shown in FIG. 6C, an attempt was made to incline the entire bottom face 43 of the clincher groove such that a front part of the bottom face 43 becomes higher than a rear part thereof. In this case, the legs 10 of the staple are unlikely to slide forward, but are likely to slide rearward along inclination of the bottom face 43 when the sheets of paper to be bound have a small thickness, resulting in a bad shape of the staple after binding the sheets of paper. In order to prevent the legs 10 of the staple from rearwardly sliding along the inclination of the bottom face 43, it may be considered to stop the slide of the legs 10 of the staple with an upright wall 44 of the clincher groove. However, in this case, there is a problem that positional accuracy of the upright wall 44 is strictly required.

DISCLOSURE OF THE INVENTION

One or more embodiments of the present invention provide a stapler having a clincher groove which can reliably and favorably fold legs of a staple, irrespective of a thickness of sheets of paper to be bound.

According to one or more embodiments of the present invention, a stapler includes a base, a magazine part configured to store a staple and rotatably supported by a rear end portion of the base, a handle part having a driver configured to strike the staple accommodated in the magazine part toward sheets of paper, the handle part being rotatably supported by the rear end portion of the base, and a clincher part having a clincher groove configured to fold legs of the staple which has been struck by the driver and has penetrated through the sheets of paper, the clincher part being provided on a front portion of the base. A width of the clincher groove in a front and rear direction is larger than a width of a side face of the staple. A bottom face of the clincher groove includes a flat face section provided as a rear portion of the bottom face in the front and rear direction, and an slope face section provided as a front portion of the bottom face in the front and rear direction. The flat face section is substantially perpendicular to a direction in which staple is struck, and the slope face section is inclined such that a front side of the slope face section is higher than the rear side of the slope face section.

According to one or more embodiments of the present invention, an angle of the bottom face of the clincher groove may gradually vary from the flat face section toward the slope face section.

According to one or more embodiments of the present invention, in a state in which a bottom face of the base is placed on a horizontal plane, the slope face section may have an angle of 3° to 5° with respect to the horizontal plane.

According to one or more embodiments of the present invention, in a state in which a bottom face of the base is placed on a horizontal plane, a front side of the flat face section may be raised such that the flat face section has an angle of 0° to 0.5° with respect to the horizontal plane.

According to one or more embodiments of the present invention, the flat face section may be substantially perpendicular to the direction in which the staple is struck under condition that two sheets of paper placed between the magazine part and the base are bound.

According to one or more embodiments of the present invention, the clincher part may be movable in up and down directions.

EXPLANATION OF REFERENCE NUMERALS

1 Stapler
2 Magazine Part
3 Handle Part
4 Clincher Part
5 Clincher Arm (a portion of a base)
15 Arm Cover (another portion of the base)
20 Clincher Groove
32 Bottom Face
33 Flat face section
34 Slope face section

BEST MODE FOR CARRYING OUT THE INVENTION

Hereinafter, embodiments of the present invention will be described in detail with reference to the drawings.

Figure 1:
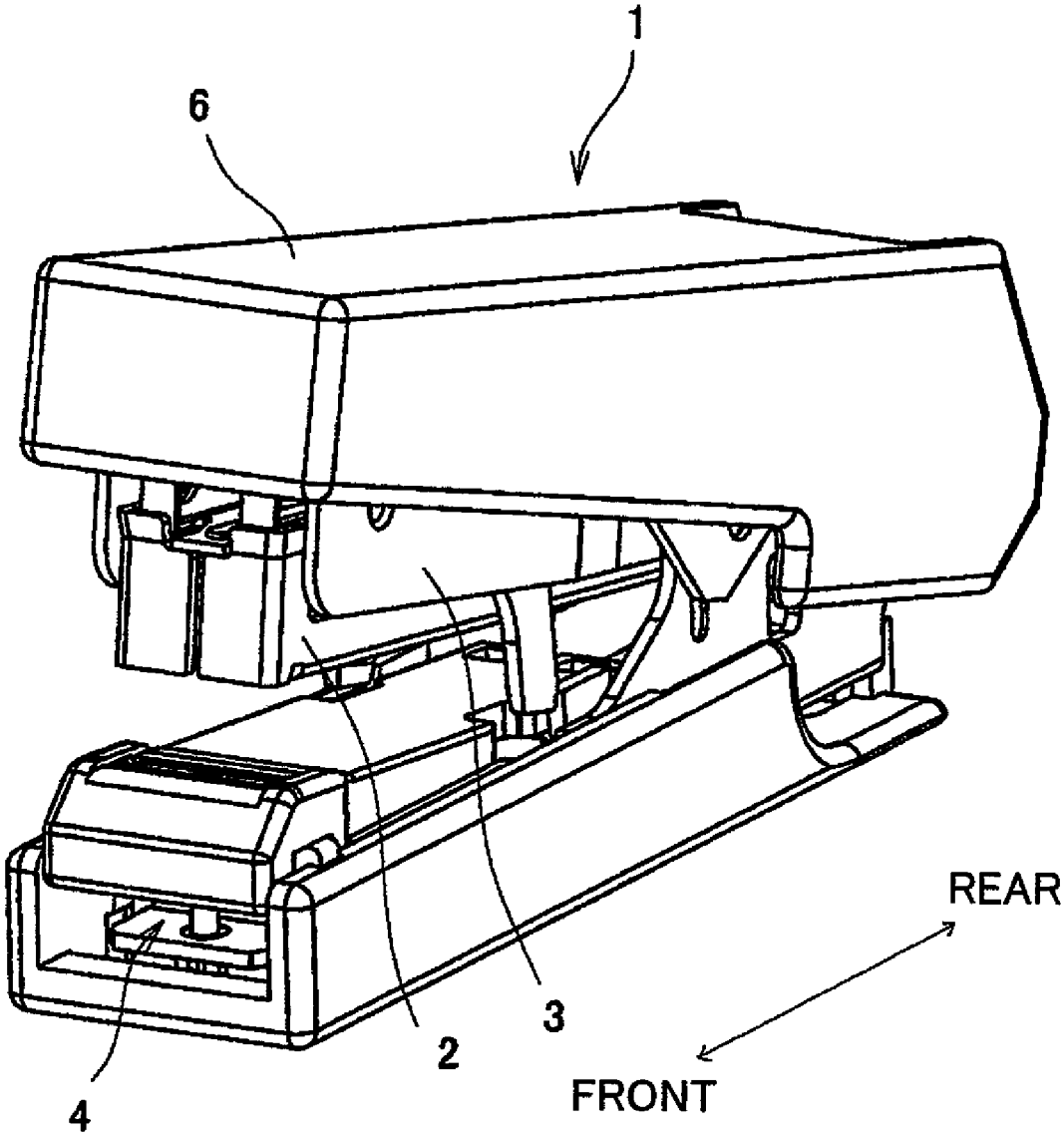
FIG. 1 is a perspective view of a stapler according to an embodiment of the present invention.
Figure 2:
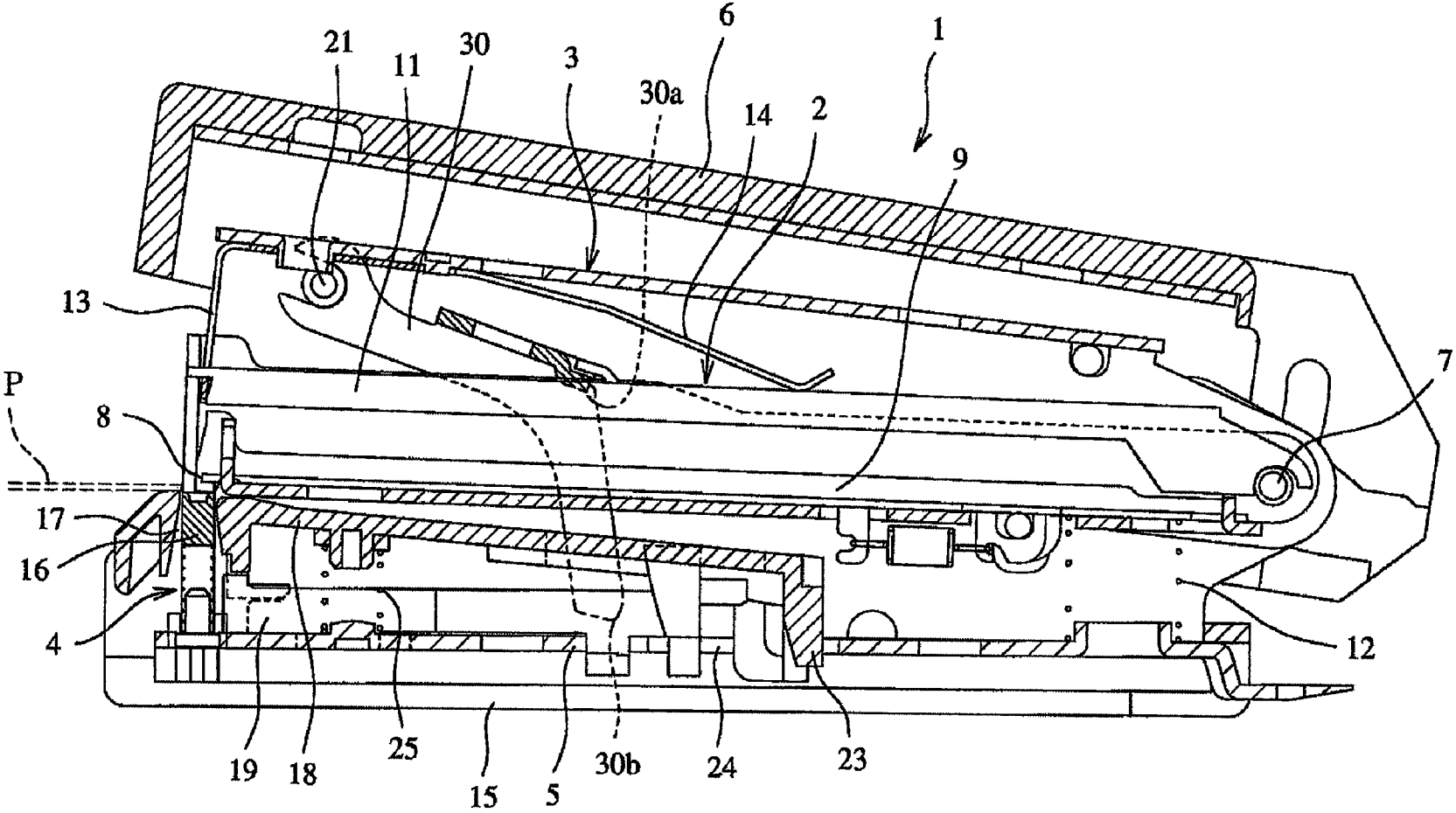
FIG. 2 is a longitudinal sectional view of the stapler shown in FIG. 1.
Figure 3:
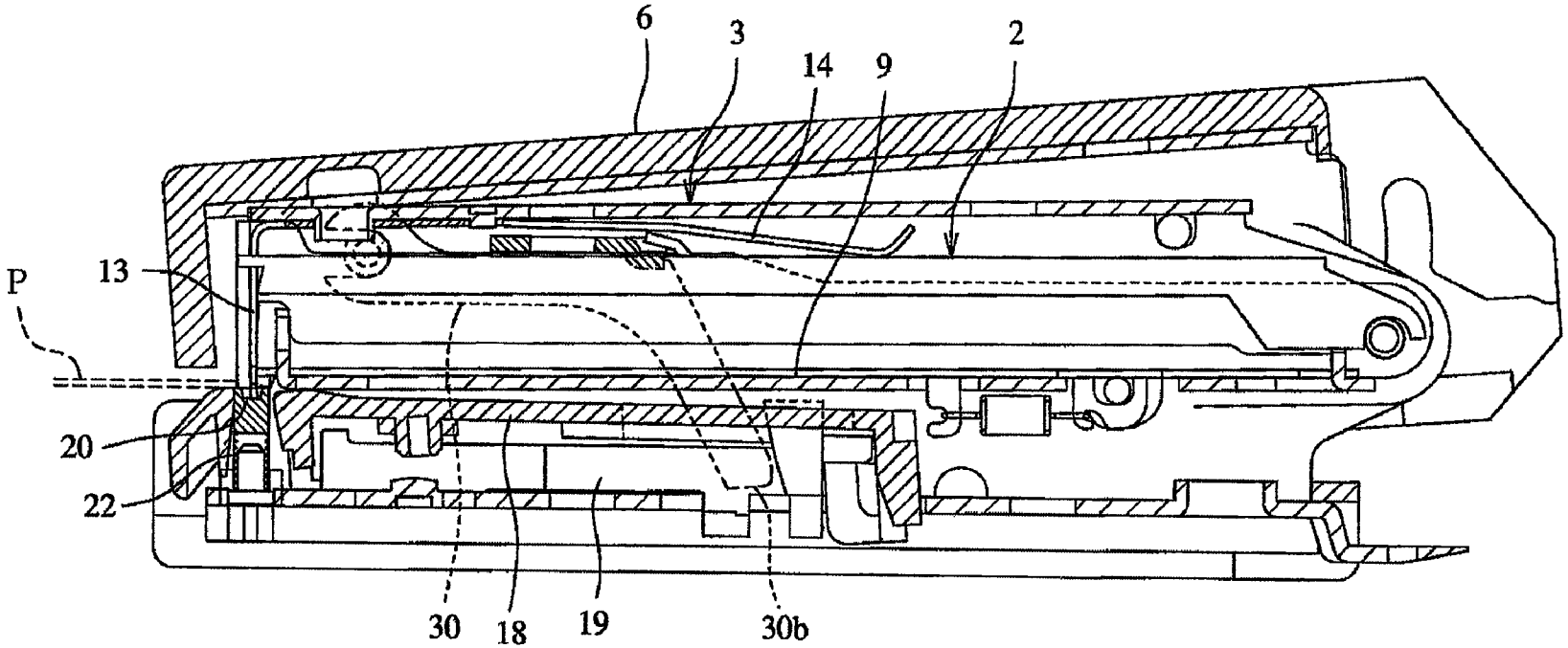
FIG. 3 is another longitudinal sectional view of the stapler shown in FIG. 1, in a state in which the stapler is in binding operation.

As shown in FIGS. 1 to 3, a stapler 1 includes a magazine part 2 which can contain a number of staples, a handle part 3 which strikes out a staple loaded in the magazine part 2 toward sheets of paper P, a clincher part 4 which folds legs of the staple, which has been driven out from the magazine part 2 and penetrated through the sheets of paper P, along a back face of the sheets of paper P, and an operating arm 6 for operating the handle part 3. The clincher part 4 is provided at a distal end portion of a clincher arm 5. Rear end portions of the magazine part 2 and the handle part 3 are rotatably supported by a support shaft 7 which is provided in a rear end portion of the clincher arm 5.

The magazine part 2 includes a magazine 9 having a striking outlet 8 at a front end portion thereof, a pusher (not shown) for pressing the staples, and a staple cover 11. The magazine part 2 is biased by a spring 12 in an upwardly rotating direction.

The handle part 3 is biased by a spring piece 14 in an upwardly rotating direction. A driver 13 which strikes out the staple from the striking outlet 8 is provided at a distal end portion of the handle part 3. By pressing down the operating arm 6, the handle part 3 is rotated, whereby the driver 13 strikes out the staple (not shown) in the magazine part 2.

A base of the stapler includes the clincher arm 5, and an arm cover 15 which is integrally attached to the clincher arm 5. The clincher part 4 is provided at the distal end portion of the clincher arm 5. The clincher part 4 includes a clincher 16, a clincher guide 18, and a slide member 19.

Figure 4A:
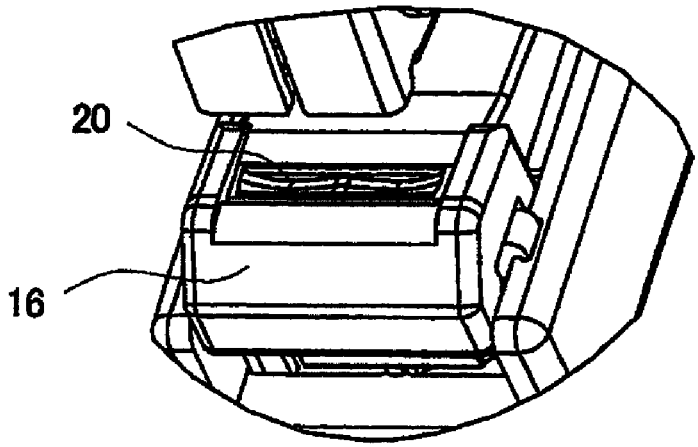
FIG. 4A is an enlarged view of a clincher part.

The clincher 16 has a clincher groove 20 (see FIGS. 4A and 4B) which engages with the legs of the staple and which guides the legs of the staple so as to be inwardly folded along the back face of the sheets of paper P. The clincher 16 is arranged to be movable in up and down directions, and is upwardly biased by a spring 22.

The clincher 16 is supported in an opening 17 at a front end of the clincher guide 18. An engaging pawl 23 is formed at a rear end of the clincher guide 18. The engaging pawl 23 is engaged with an edge of an opening 24 of the clincher arm 5 to swingably support the clincher guide 18. A spring 25 biases the clincher guide 18 such that the clincher guide 18 is upwardly rotatable within a certain range. The opening 17 of the clincher guide 18 is swung in a substantially vertical direction along the clincher 16.

The slide member 19 is supported so as to be slidable in front and rear directions along a bottom wall of the clincher arm 5, and is forwardly biased by a spring (not shown). When the slide member 19 is in a forward position, the slide member 19 engages with the clincher guide 18 to prevent the clincher guide 18 from swinging downward thereby to support the sheets of paper P in an upper position. When the slide member 19 moves rearward, the distal end portion of the clincher guide 18 is allowed to swing downward.

One end portion of a link member 30 is pivotally supported by the handle part 3 via a shaft 21. The link member 30 has an L-shape, and a curved intermediate portion 30*a* of the link member 30 is engaged with an upper face of the staple cover 11 in a sliding contact manner. The other end portion 30*b* extending downward is engageable with the slide member 19. When the handle part 3 is relatively rotated with respect to the magazine part 2, the link member 30 is rotated around the curved intermediate portion 30*a* serving as a pivot, and the other end portion 30*b* engages with rearwardly slides the slide member 19 against the spring.

In the configuration described above, the sheets of paper P are placed on an upper face of the clincher guide 18 as shown in FIG. 2, and the operating arm 6 is pressed down, whereby the handle part 3 is rotated, and the magazine part 2 is pressed down via the plate spring piece 14 of the handle part 3 and is rotated. Consequently, the sheets of paper P are clamped between a lower face of the magazine 9 and the clincher guide 18. At this time, the slide member 19 is positioned below a lower face of a front portion of the clincher guide 18 to hold the clincher guide 18 in an upper position. Accordingly, the sheets of paper P are held in the upper position, and the rotation of the magazine part 2 is stopped. When the handle part 3 is further rotated, a headmost staple in the magazine 9 is driven out toward the sheets of paper P by the driver 13 of the handle part 3, and the legs of the staple penetrate through the sheets of paper P.

The legs of the staple come into contact with the clincher 16 after penetrating through the sheets of paper P, and press down the clincher 16 against the spring 22. However, because a spring force of the spring 22 is very weak, the clincher 16 does not function to fold the legs of the staple at this point. When substantially the entire legs of the staple have penetrated through the sheets of paper P, the link member 30 is rotated along with the rotations of the handle part 3 and the magazine part 2 as shown in FIG. 3, and the other end portion 30*b* of the link member 30 engages with the slide member 19 to rearwardly slide the slide member 19. Accordingly, the distal end portion of the clincher guide 18 is rotated downward, and the magazine part 2 is rotated while downwardly pressing the clincher guide 18 with a spring force of the plate spring piece 14.

Thereafter, by pressing down the operating arm 6, the handle part 3 is further rotated to further rotate the clincher guide 18 downward. Distal ends of the legs of the staple are engaged with the clincher groove 20 of the clincher 16, and the legs of the staple are flatly folded along the back face of the sheets of paper P, whereby the staple binding operation is completed.

Figure 4B:
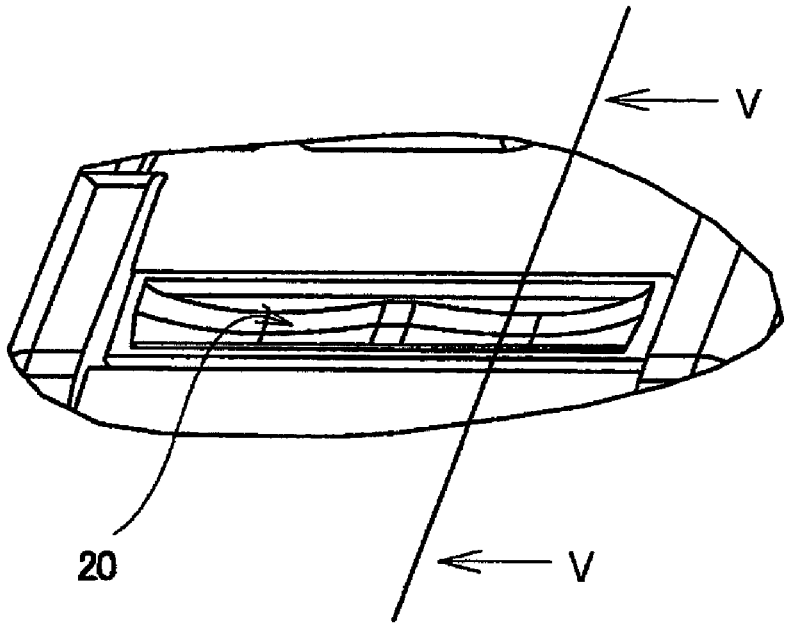
FIG. 4B is a further enlarged view of FIG. 4A.
Figure 5A:
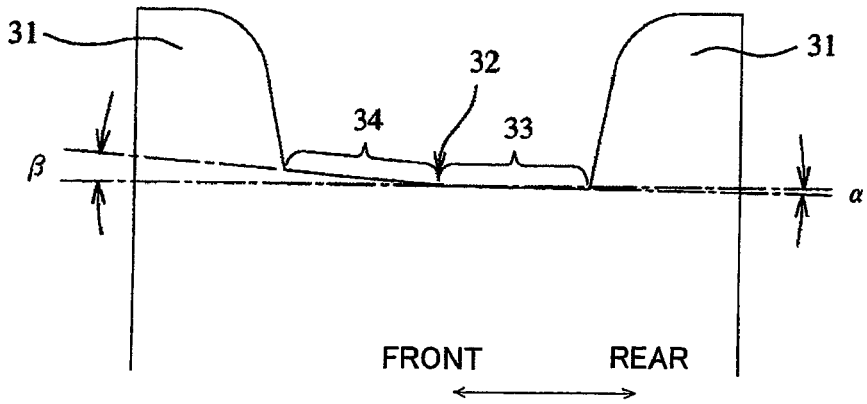
FIG. 5A is a cross sectional view of a clincher groove according to an embodiment of the present invention, taken along the line V-V in FIG. 4B.

FIG. 5A is a sectional view of the clincher groove 20 of the clincher 16 according to the embodiment of the present invention, taken along the line V-V in FIG. 4B.

As shown in FIG. 5A, the clincher groove 20 is formed between front and rear upright walls 31, and between right and left upright walls (not shown). A front-and-rear width of a bottom face 32 of the clincher groove 20 is formed larger than a width of a side face of the staple.

The bottom face 32 of the clincher groove 20 has a flat face section 33 on a rear side in the front-and-rear widthwise direction (on the right side in FIG. 5A). The flat face section 33 is formed substantially horizontally and is substantially perpendicular with respect to a striking direction the staple. The bottom face 32 further has an slope face section 34 on a front side in the front-and-rear widthwise direction. The slope face section 34 is inclined such that its front portion is higher than its rear portion. The slope face section 34 and the flat face section 33 are contiguously provided.

As described above, according to the conventional clincher groove, when the staple is driven by the driver 13 and is engaged with the clincher groove after penetrating though the sheets of paper, the in a case in which the sheets of paper to be bound have a small thickness, the distal ends of the legs of the staple are likely to slide forward, so that the legs of the staple tend to be inclined rearward. In a case in which the sheets of paper to be bound have a large thickness, the bent legs are likely to move forward, because an angle of the sheets of paper does not match with an angle of the bottom face 32 of the clincher groove 20. Therefore, also in this case, the legs of the staple are likely to be inclined rearward.

Figure 5B:
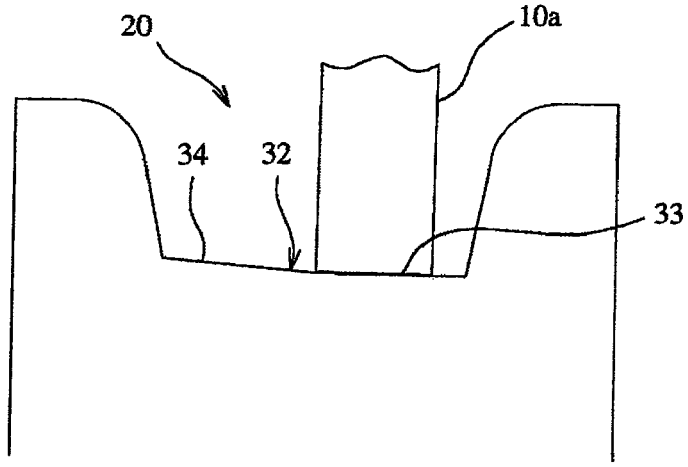
FIG. 5B is a cross sectional view illustrating a leg of a staple which is engaged with a bottom face of the clincher groove shown in FIG. 5A.

However, according to the clincher groove of the embodiment, of the present invention, in a case in which the sheets of paper to be bound have a small thickness, as shown in FIG. 5B, the legs 10*a* of the staple are engaged with the flat face section 33 which is the rear part of the bottom face 32 of the clincher groove 20. The flat face section 33 is horizontal, and a distance between the legs 10*a* and the upright wall 31 positioned in front is larger than a distance between the legs 10*a* and the upright wall 31 positioned on the rear side. However, the distal ends of the legs 10*a* of the staple do not slide forward because of the slope face section 34 provided as the front portion of the bottom face 32 of the clincher groove 20. Therefore, it is possible to reliably prevent the staple from being inclined rearward. Further, the clincher 16 can be easily mounted because accuracy in position of the upright walls 31 of the clincher groove 20 is not strictly required.

Figure 5C:
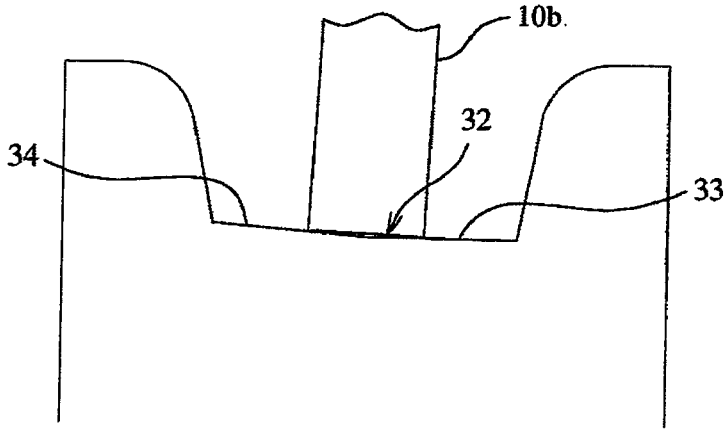
FIG. 5C is another cross sectional view illustrating the leg of the staple which is engaged with the bottom face of the clincher groove shown in FIG. 5A.
Figure 6A:
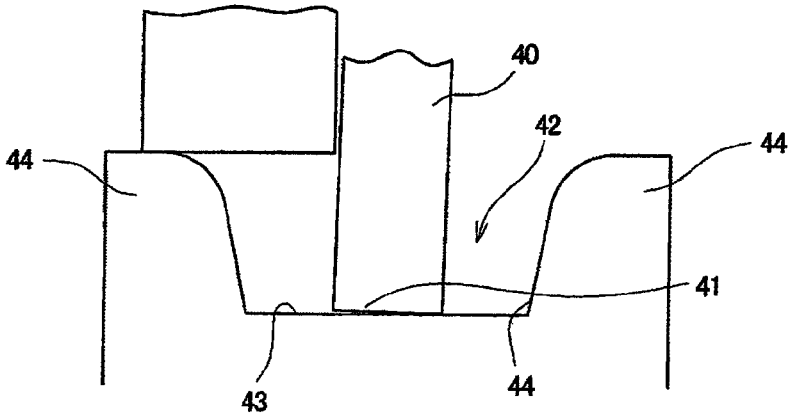
FIG. 6A is a cross sectional view of a clincher groove of a conventional stapler.
Figure 6B:
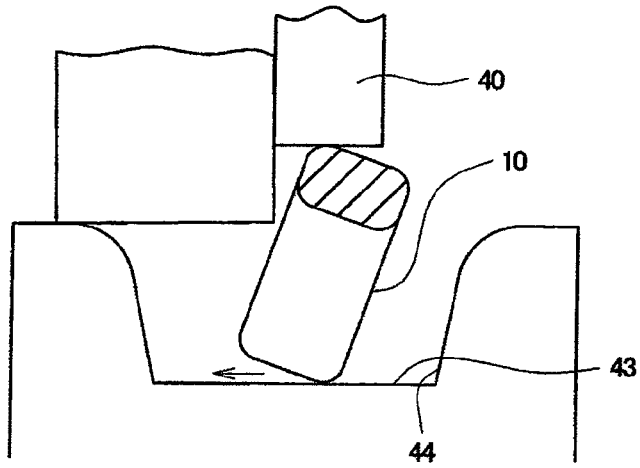
FIG. 6B is a cross sectional view illustrating a leg of a staple which is bent on the clincher groove shown in FIG. 6A.
Figure 6C:
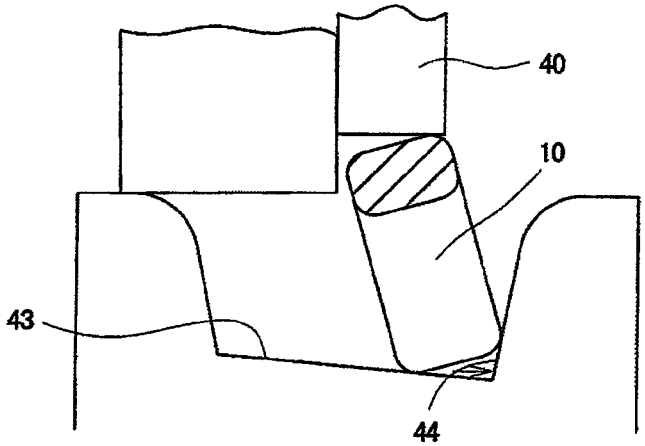
FIG. 6C is a cross sectional view of a clincher groove of another conventional stapler.

On the other hand, in a case in which the sheets of paper to be bound have a large thickness, the legs 10*b* are likely to move forward as shown in FIG. 5C because an angle of the sheets of paper becomes unmatched with an angle of the bottom face 32 of the clincher groove 20. However, also in this case, the distal ends of the legs 10*b* of the staple do not slide forward because of the slope face section 34 is provided as the front portion of the bottom face 32 of the clincher groove 20. In addition, the legs 10*b* do not slide rearward because rear sides of the legs 10*b* are in contact with the horizontal flat face section 33 which is formed at an angle with respect to the slope face section 34. Therefore, it is possible to reliably prevent the staple from being inclined.

As described above, according to the clincher groove of the embodiment of the present invention, it is possible to reliably and favorably fold the legs of the staple, regardless of whether the thickness of the sheets of paper is large or small.

It is preferable that, in a state in which a bottom face of the base of the stapler is placed on the horizontal plane, the flat face section 33 have an angle a of 0° to −0.5° with respect to the horizontal plane. That is, the flat face section 33 is preferably formed so as to be horizontal or slightly inclined rearwardly downward. Further, it is preferable that the slope face section 34 have an angle β of 3° to 5° with respect to the horizontal plane. If the flat face section 33 is inclined forwardly downward, the legs of the staple which have penetrated through the sheets of paper become likely to slide forward. If an absolute value of the angle a is larger than 0.5°, in a case in which the sheets of paper to be bound has a small thickness, the distal ends of the legs of the staple are likely to slide rearward so that the legs of the staple are likely to be inclined forward. If the angle β of the inclined front face part 34 with respect to the horizontal plane is smaller than 3°, effect of preventing the legs of the staple from sliding forward decreases. If the angle β is larger than 5°, the angle becomes so large that the legs of the staple becomes likely to slide rearward.

The bottom face 32 of the clincher groove 20 may be formed such that the angle with respect to the horizontal plane may gradually vary from the flat face section 33 on rear side to the slope face section 34 on the front side.

Moreover, the flat face section 33 may be formed to be substantially perpendicular to the striking direction of the staple under the condition that two sheets of superposed papers are to be bound. In this case, binding effect having a good finish can be obtained, even in a case in which the two sheets of paper are bound.

The clincher groove 20 need not necessarily be of a movable type as in-the embodiment, and may be of a fixed type to obtain a similar effect.

While embodiments of the present invention has been described, it would be apparent to those skilled in the art that various changes and modifications can be made therein without departing from the sprit and scope of the present invention.

The present application is based on Japanese Patent Application No. 2006-263377 filed on Sep. 27, 2006, the content of which is incorporated herein by reference.

INDUSTRIAL APPLICABILITY

It is possible to provide a stapler which can reliably and favorably fold legs of a staple irrespective of a thickness of sheets of paper to be bound.

The invention claimed is:

1. A stapler comprising:

a base;

a magazine part configured to store a staple and rotatably supported by a rear end portion of the base;

a handle part comprising a driver configured to strike the staple accommodated in the magazine part toward sheets of paper, the handle part being rotatably supported by the rear end portion of the base; and a clincher part comprising a clincher groove configured to fold legs of the staple which has been struck by the driver and has penetrated through the sheets of paper, the clincher part being provided on a front portion of the base, wherein a width of the clincher groove in a front and rear direction is larger than a width of a side face of the staple, wherein the clincher groove is defined by a front upright wall, a back upright wall, and a bottom face extending from the front upright wall to the back upright wall, the bottom face comprising first and second flat face sections, the first flat face section extending from the front upright wall and transitioning into the second flat face section, and the second flat face section extending to the back upright wall, the second flat face section is substantially perpendicular to a direction in which the staple is struck, and the first flat face section is inclined such that a front side of the first flat face section is higher than the rear side of the first flat face section.

2. The stapler according to claim 1, wherein an angle of the bottom face of the clincher groove gradually varies from the second flat face section toward the first flat face section.

3. The stapler according to claim 1, wherein, in a state in which a bottom face of the base is placed on a horizontal plane, the first flat face section has an angle of 3° to 5° with respect to the horizontal plane.

4. The stapler according to claim 1, wherein, in a state in which a bottom face of the base is placed on a horizontal plane, a front side of the second flat face section is raised such that the second flat face section has an angle of 0° to 0.5° with respect to the horizontal plane.

5. The stapler according to claim 1, wherein the second flat face section is substantially perpendicular to the direction in which the staple is struck under condition that two sheets of paper placed between the magazine part and the base are bound.

6. The stapler according to claim 1, wherein the clincher part is movable in up and down directions.

7. The stapler according to claim 1, wherein the clincher groove is configured such that the legs of the staple are folded at different locations on the bottom face in the front and rear direction, depending on a thickness of the sheets of paper.

* * * * *